US005149926A

United States Patent [19]

Ono

[11] Patent Number: 5,149,926

[45] Date of Patent: Sep. 22, 1992

[54] ACCELERATION SENSOR

[75] Inventor: Katsuyasu Ono, Chigasaki, Japan

[73] Assignee: Nippon Seiko Kabushiki Kaisha, Tokyo, Japan

[21] Appl. No.: 606,719

[22] Filed: Oct. 31, 1990

[30] Foreign Application Priority Data

Nov. 8, 1989 [JP] Japan ..... 1-130406[U]
Sep. 13, 1990 [JP] Japan ..... 2-96411[U]

[51] Int. Cl.[5] ..... H01H 35/14

[52] U.S. Cl. ..... 200/61.45 M; 200/61.45 R; 200/61.52; 200/61.53

[58] Field of Search ..... 200/61.45 M, 61.45 R, 200/48, 61.52, DIG. 29, 61.53

[56] References Cited

U.S. PATENT DOCUMENTS 3,927,286 12/1975 Föhl ..... 200/61.45 R
4,326,111 4/1982 Jackman ..... 200/61.45 R
4,533,801 8/1985 Jackman ..... 200/61.45 R

FOREIGN PATENT DOCUMENTS 50-14345 5/1975 Japan .
221563 2/1990 Japan .

*Primary Examiner*—A. D. Pellinen
*Assistant Examiner*—D. Le
*Attorney, Agent, or Firm*—Wegner, Cantor, Mueller & Player

[57] ABSTRACT

An acceleration sensor has a spherical inertial mass (2) formed of a magnetic material. A magnet (3) has a holding part (3*a*) for normally holding the inertial mass (2) seated thereat. A switch changeover member (5) is actuatable by the inertial mass (2) when the inertial mass (2) moves out of the holding part (3*a*) onto one surface (3*b*) of the magnet (3) upon exertion of acceleration having a predetermined or larger magnitude on the inertial mass (2), for changing the position of a switch (4). A magnetic member (6) is secured to the other surface (3*c*) of the magnet (3), with one end thereof located in the holding part (3*a*), and the other end thereof shaped to cover an opposed end of the magnet (3), in a manner such that magnetic lines of force are generated in a manner being concentrated around the holding part (3*a*) of the magnet (3) and on the opposed end of same. Alternatively, the inertial mass (2) is normally mechanically held at a holding part (3*a*, 5*e*), and the magnetic member (6) has one end thereof shaped to cover an opposed and of the magnet (3), in a manner such that magnetic lines of force are generated in a manner being concentrated solely on the opposed end of the magnet.

17 Claims, 8 Drawing Sheets

ACCELERATION SENSOR

BACKGROUND OF THE INVENTION

This invention relates to an acceleration sensor for detecting acceleration acting on a vehicle, and more particularly to an acceleration sensor of this kind which can be used, for example, in controlling a passive seat belt, one end of which is fixed to a retractor located on the floor of the vehicle compartment, and the other end can be moved forward and backward along a roof rail as the door is opened and closed, and in controlling a fuel pump. For example, the acceleration sensor can be used so that the other end of the seat belt may be prevented from moving forward along the roof rail even if the door is opened, or to stop the operation of the fuel pump, when acceleration caused by a crash of the vehicle is detected.

Conventionally, acceleration sensors have been proposed, e.g. by Japanese Patent Publication (Kokoku) No. 50-14345, U.S. Pat. No. 4,326,111, and Japanese Provisional Utility Model Publication (Kokai) No. 2-21563, in which an inertial mass is held in a predetermined position by at least one of gravity, the force of a spring, and a magnetic force, before a predetermined or larger magnitude of acceleration acts thereon, while once the predetermined or larger magnitude of acceleration acts thereon, the inertial mass is displaced from the predetermined position to actuate a switch.

However, the conventional acceleration sensors require a special holding mechanism to hold the inertial mass in the displaced position, which utilizes snap action of a spring. Therefore, the sensors have complicated constructions.

SUMMARY OF THE INVENTION

It is the object of the invention to provide an acceleration sensor which makes use of the magnetic force of a magnet in order to hold the inertial mass in a position into which the inertial mass is displaced due to a predetermined or larger magnitude of acceleration acting thereon, to thereby enable to dispense with a special holding mechanism for holding the displaced inertial mass in the displaced position, and hence simplify the construction of the sensor.

To attain the object, according to a first aspect of the invention, there is provided an acceleration sensor comprising:

a spherical inertial mass formed of a magnetic material having a predetermined amount of mass;

a magnet having a holding part for normally holding the inertial mass seated thereat, a first surface with which the inertial mass is brought into contact when the inertial mass moves from the holding part, and a second surface opposite to the first surface;

a switch;

a switch changeover member being actuatable by the inertial mass when the inertial mass moves out of the holding part onto the first surface of the magnet upon exertion of acceleration having a predetermined or larger magnitude on the inertial mass, for changing the position of the switch; and a magnetic member secured to the second surface of the magnet, the magnetic member having one end thereof located in the holding part, and another end thereof shaped to cover an opposed end of the magnet, in a manner such that magnetic lines of force are generated in a manner being concentrated around the holding part of the magnet and on the opposed end of said magnet.

Preferably, the magnet is in the form of an annulus having an inner peripheral surface defining a holding hole as the holding part at a central portion thereof, and an outer peripheral surface, the magnetic member being in the form of an annulus and secured to the second surface of the magnet at a whole area thereof, the magnetic member having an inner peripheral portion bent to cover the inner peripheral surface of the magnet, and an outer peripheral portion bent to cover the outer peripheral surface of the magnet.

The switch changeover member is displaceable to thereby change the position of the switch by the inertial mass when the inertial mass moves out of the holding hole onto the first surface of the magnet.

The switch changeover member has a contact surface disposed in contact with the inertial mass.

Preferably, the acceleration sensor includes a resetting member provided on the switch changeover member for pressing said switch changeover member against the inertial mass. The contact surface of the switch changeover member has a sloping surface for causing the inertial mass to return to the holding hole when the resetting member is pressed down to press the switch changeover member against the inertial mass while the inertial mass is on the first surface of the magnet.

In another preferred form, the acceleration sensor includes a resetting member arranged at a side of the switch changeover member remote from the inertial mass and being movable relative to the switch changeover member, and a spring interposed between the resetting member and the switch changeover member and urging the switch changeover member in urging contact with the inertial mass, the resetting member having a sloping surface opposed to the inertial mass for causing the inertial mass to return to the holding part when the resetting member is pressed down while the inertial mass is on the first surface of the magnet.

In still another preferred form, the magnet is in the form of an oblong plate, the magnet having one end thereof formed with the holding part, the magnetic member being in the form of an oblong plate and secured to the second surface of the magnet at a whole area thereof, the magnetic member having one end thereof bent to cover the one end of the magnet, and another end thereof bent to cover another end of the magnet.

The switch changeover member is disposed for pivotal movement to thereby change the position of the switch by the inertial mass when the inertial mass moves out of the holding part onto the first surface of the magnet.

In a further preferred form, the acceleration sensor includes an inertial mass assembly in the form of a pendulum having a rod, the inertial mass being secured to one end of the rod, and a fulcrum secured to another end of the rod, the fulcrum serving as the switch changeover member, and a holder engaging with the fulcrum for allowing swinging of the inertial mass assembly about the fulcrum, and when the inertial mass moves out of the holding part onto the first surface of the magnet, the inertial mass assembly is swung about the fulcrum, whereby the switch changeover member is displaced to change the position of the switch.

Preferably, the acceleration sensor includes a non-magnetic sheet member arranged on the first surface of the magnet.

According to a second aspect of the invention, there is provided an acceleration sensor comprising:

a spherical inertial mass formed of a magnetic material having a predetermined amount of mass;

a holding part for normally holding the inertial mass seated thereat;

holding means for mechanically holding the inertial mass at the holding part;

a magnet forming part of the holding part, the magnet having a first surface with which the inertial mass is brought into contact when the inertial mass moves from the holding part, and a second surface opposite to the first surface;

a switch;

a switch changeover member being actuatable by the inertial mass when the inertial mass moves away from the holding part along the first surface of the magnet upon exertion of acceleration having a predetermined or larger magnitude on the inertial mass, for changing the position of the switch; and a magnetic member secured to the second surface of the magnet, the magnetic member having one end thereof shaped to cover an opposed end of the magnet, in a manner such that magnetic lines of force are generated in a manner being concentrated solely on the opposed end of the magnet.

In a preferred form, the magnet is in the form of a flat disc, and the magnetic member is in the form of a dish.

Advantageously, the holding means comprises urging means urging the inertial mass against the magnet normally at the holding part.

The above and other objects, features, and advantages of the invention will become more apparent from the ensuing detailed description taken in conjunction with the accompanying drawings.

DETAILED DESCRIPTION

Figure 1:
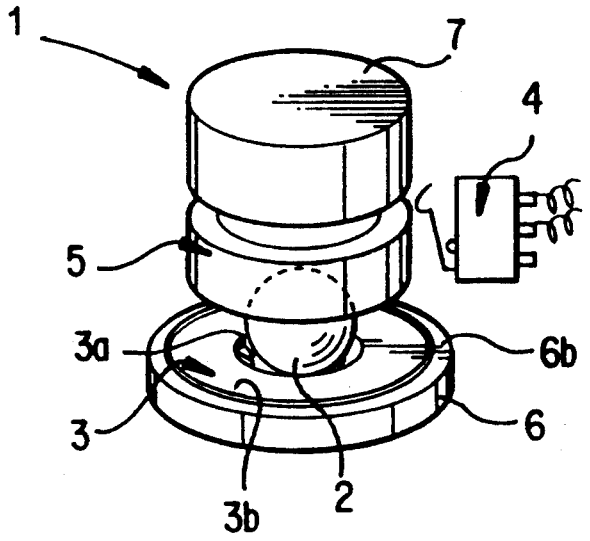
FIG. 1 is a perspective view of an acceleration sensor according to a first embodiment of the invention.

The invention will now be described in detail with reference to the drawings showing embodiments thereof. In the following description and the drawings, identical or corresponding component elements and parts are designated by identical reference numerals, and repeated descriptions thereof will be omitted.

FIG. 1 shows an acceleration sensor according to a first embodiment of the invention. In the figure, reference numeral 1 designates an acceleration sensor for detecting acceleration generated upon crash of a vehicle.

Figure 2:
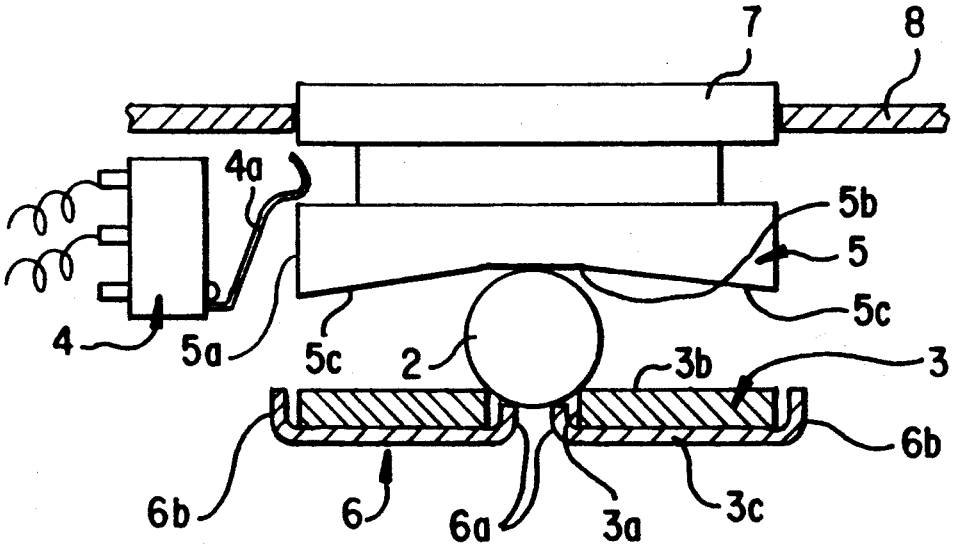
FIG. 2 is a cross-sectional view of essential parts of the acceleration sensor of FIG. 1.

As shown in FIGS. 1 and 2, the acceleration sensor 1 comprises a spherical inertial mass 2 formed of a magnetic material and having a predetermined amount of mass, a magnet 3 having a holding through hole (holding part) 3*a* for holding the inertial mass 2 in place when a predetermined or larger magnitude of acceleration does not act thereon, a switch changeover member 5 which is actuated by the inertial mass 2 when it moves out of the through hole 3*a* onto the surface 3*b* of the magnet 3 upon crash of the vehicle, for changing the position of a switch 4, and a magnetic member 6 having high magnetic permeability and secured on the whole lower side surface 3*c* of the magnet 3.

The magnet 3 is in the form of an annulus having the holding through hole 3*a* formed in the center thereof. The magnetic member 6 is also in the form of an annulus having an inner peripheral portion (one end) 6*a* upwardly bent so as to cover the inner peripheral surface of the through hole 3*a*, and an outer peripheral portion 6*b* (another end) upwardly bent so as to cover the outer peripheral surface (opposed end) of the annular magnet 3. By virtue of the above construction of the magnet 3 and the magnetic member 6, magnetic lines of force are generated in a manner being concentrated around the holding through hole 3*a* of the magnet 3 and on the outer peripheral portion 6*b* of same (see FIG. 5), since the magnetic lines of force pass through the magnetic member 6 having high magnetic permeability.

Figure 3:
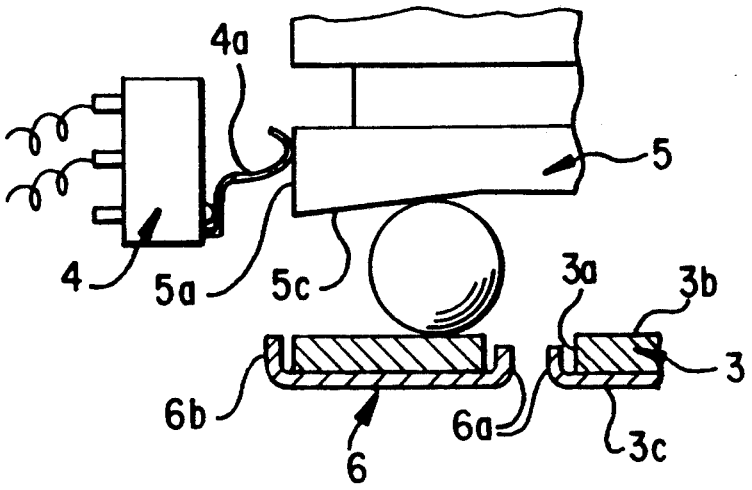
FIG. 3 is a fragmentary view, partly in section, of the acceleration sensor of FIG. 1 in a state in which the inertial mass is being displaced on the surface of a magnet.

The switch changeover member 5 is forcedly displaced upward by the inertial mass 2 when it moves out of the holding through hole 3*a* onto the surface 3*b* of the magnet 3 upon crash of the vehicle, so that the peripheral surface 5*a* thereof pushes a movable contact 4*a* of the switch 4, as shown in FIG. 3, to actuate or change the position of the switch 4. A resetting member 7 is formed integrally on the top of the switch changeover member 5. The resetting member 7 and the switch changeover member 5 are vertically slidable relative to a casing 8, and urged downward by a spring, not shown, such that normally, a contact surface 5*b* of the switch changeover member 5 is in urging contact with top of the inertial mass 2. Further, the contact surface 5*b* of the switch changeover member 5 has a sloping portion 5*c* for urgingly returning the inertial mass 2 to the holding through hole 3*a* when the resetting member 7 is pressed down to press the switch changeover member 5 downward when the inertial mass is on the surface 3*b* of the magnet 3 (a state shown in FIG. 3 or FIG. 4).

The switch 4 may form a part of a passive seat belt device and supply a control circuit thereof, not shown, with a signal for preventing one end of the seat belt from moving forward along the roof rail when the door is opened upon crash of the vehicle.

Now, the operation of the acceleration sensor according to the first embodiment of the invention will be described.

Figure 5:
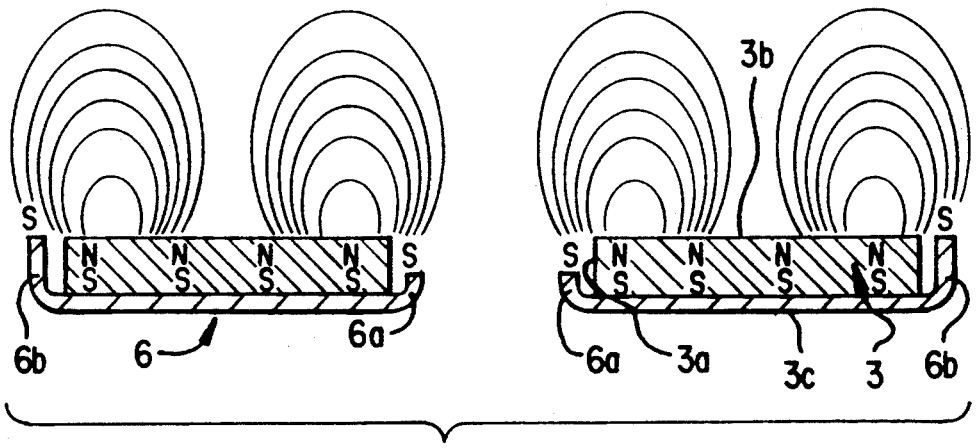
FIG. 5 is a schematic view of the magnet and a magnetic member mounted thereon, depicting magnetic lines of force generated thereby.
Figure 6:
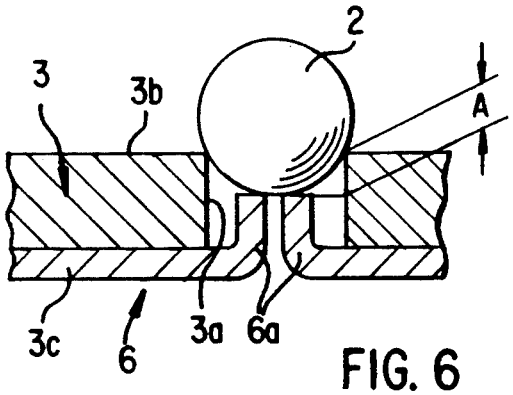
FIG. 6 is an enlarged fragmentary cross-sectional view of the acceleration sensor in a state in which the inertial mass is held in a holding part of the acceleration sensor.

Normally, the inertial mass 2 is held in a predetermined reference position, i.e. seated in the holding through hole 3*a* by the urging force of the aforementioned spring, not shown, acting on the switch changeover member 5, gravity, and the magnetic force of the magnet 3. On this occasion, a strong magnetic force is generated in the vicinity of the holding through hole 3*a* of the magnet 3 due to the magnetic lines of force concentrated around the through hole 3*a*, as illustrated in FIG. 5. Therefore, the inertial mass 2 can be held in the through hole 3*a* by a strong holding force due to the strong magnetic force. As a result, acceleration having a larger magnitude can be detected by the stronger holding force. In addition, the lower limit magnitude of acceleration that can be detected can be adjusted by varying a drop A of the inertial mass 2 into the holding hole 3*a* (see FIG. 6), the magnetic force, and the urging force of the aforementioned spring, not shown.

If acceleration having a predetermined or larger magnitude is exerted on the vehicle, the inertial mass 2 moves out of the holding through hole 3*a* of the magnet 3 onto the surface 3*b* of same, and moves on the surface 3*b* toward the outer periphery of same. At the same time, the switch changeover member 5 is forcedly displaced upward by the inertial mass 2, so that the outer peripheral surface 5*a* of the switch changeover member 5 pushes the movable contact 4*a* of the switch 4 to actuate the switch 4 (a state shown in FIG. 3). When the inertial mass 2 further moves on the surface 3*b* of the magnet 3 from the position shown in FIG. 3 toward the outer periphery of same, the inertial mass 2 is attracted to the outer periphery of the magnet 3 and held thereat (a state shown in FIG. 4) by a strong magnetic force concentratedly generated at the outer periphery of the magnet 3 due to the thick magnetic lines of force formed as illustrated in FIG. 5.

Thus, in order to hold the inertial mass 2 in a displaced position (position shown in FIG. 4) into which the inertial mass 2 has moved from the holding through hole 3*a* due to exertion of acceleration having a predetermined or larger magnitude on the inertial mass 2, the acceleration sensor 1 according to the invention makes use of the magnetic force generated by the magnet 3 exerted on the inertial mass 2 in the displaced position, which makes it possible to dispense with a special holding mechanism and hence simplify the construction of the sensor.

Figure 4:
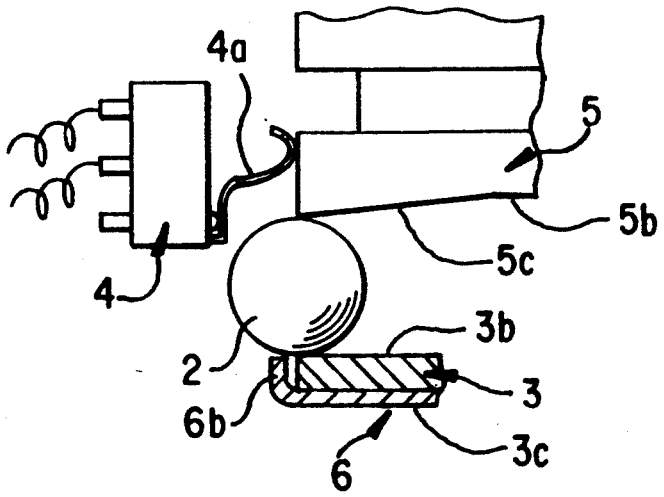
FIG. 4 is a similar view to FIG. 3 showing the sensor in a state in which the inertial mass is held at the periphery of the magnet.

If the resetting member 7 is pressed down when the inertial mass 2 is in the displaced position shown in FIG. 4, the switch changeover member 5 is forcedly displaced downward together therewith, so that the inertial mass 2 is moved on the surface 3*b* of the magnet 3 toward the holding through hole 3*a* by virtue of the slope of the sloping portion 5*c* of the switch changeover member 5. When the inertial mass 2 comes near the holding through hole 3*a*, it is attracted to the holding through hole 3*a* by the strong magnetic force generated around the through hole 3*a* and thereby becomes seated therein. Thus, the resetting of the acceleration sensor 1 is completed.

Further, during the movement of the inertial mass 2 on the surface 3*b* of the magnet 3 to and from the holding through hole 3*a*, the magnetic force of the magnet 3 is exerted on the inertial mass 2, whereby the inertial mass 2 will not bound or overshoot.

Figure 7:
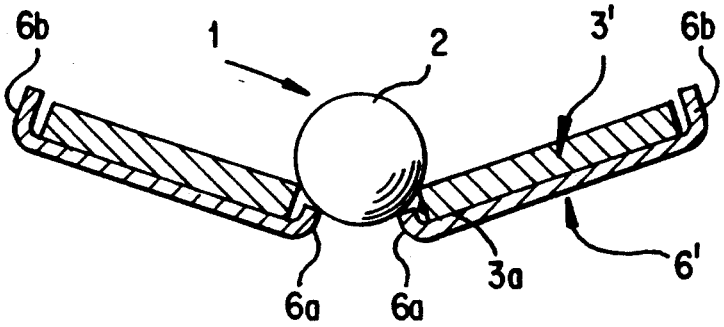
FIG. 7 is a cross-sectional view of essential parts of an acceleration sensor according to a second embodiment of the invention.

FIG. 7 shows essential parts of an acceleration sensor according to a second embodiment of the invention. In the first embodiment described above, the annular magnet 3 is generally flat. In contrast, in the second embodiment, an annular magnet 3′ in the form of a truncated cone is employed. The magnet 3′ is upwardly sloped from its inner periphery around the holding through hole 3*a* toward its outer periphery. Accordingly, a magnetic member 6′ is used in this embodiment, which is also in the form of a truncated cone to match the shape of the magnet 3′. The other parts are constructed similarly to those in the first embodiment described above.

According to the acceleration sensor 1 of the second embodiment, since the annular magnet 3′ is in the form of a truncated cone upwardly sloped from its inner periphery toward its outer periphery, the inertial mass 2 can be more readily returned from the position shown in FIG. 4 to the holding through hole 3*a*.

Next, a third embodiment of the invention will be described with reference to FIGS. 8 and 9.

Figure 8:
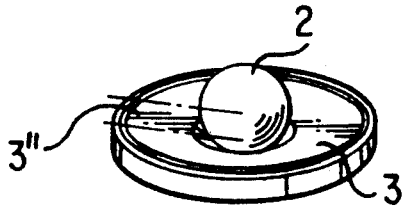
FIG. 8 is an explanatory view useful in explaining the construction of a magnet in the form of an oblong plate used in an acceleration sensor according to a third embodiment of the invention.
Figure 9:
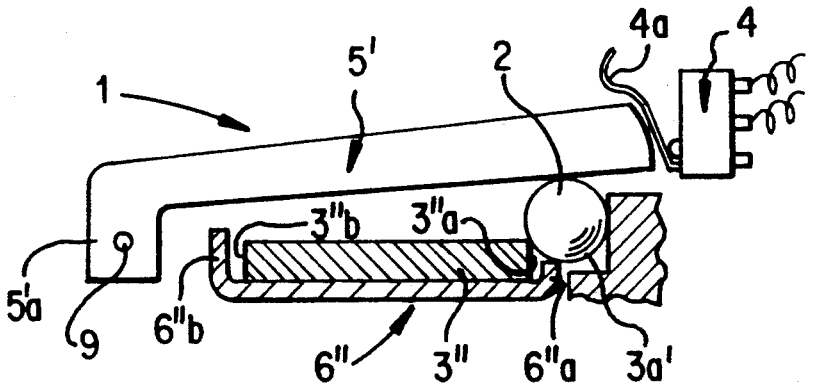
FIG. 9 is a cross-sectional view of essential parts of the acceleration sensor according to the third embodiment of the invention.

In the third embodiment, as the magnet, there is used a magnet 3″ in the form of an oblong plate which corresponds to a portion obtained from the magnet 3 of the first embodiment by cutting the magnet 3 along the one-dot chain lines shown in FIG. 8. A magnetic member 6″ is used in this embodiment, which is also in the form of an oblong plate which matches in shape the magnet 3″. At one end of the magnet 3″, there is formed a holding part 3*a* in which the inertial mass 2 is held before acceleration having a predetermined or larger magnitude acts thereon. One end 6″*a* of the magnetic member 6″ is upwardly bent so as to cover the one end 3″*a* of the magnet 3″, while the other end 6″*b* of same is also upwardly bent so as to cover the other end 3″*b* of the magnet 3″. Further, in this embodiment, as the switch changeover member 5, there is provided a rotating lever 5′ which has one end 5′*a* pivotally supported by a stationary fulcrum 9 and is actuated by the inertial mass 2 when it moves out of the holding part 3*a'* onto the surface of the magnet 3", for pivotal movement about the fulcrum 9 in the counterclockwise direction, whereby the switch 4 is actuated.

The acceleration sensors according to the first and second embodiments of the invention are suitable for detecting acceleration acting in any direction, whereas the acceleration sensor according to the third embodiment is suitable for detecting acceleration acting in only one direction.

Figure 10:
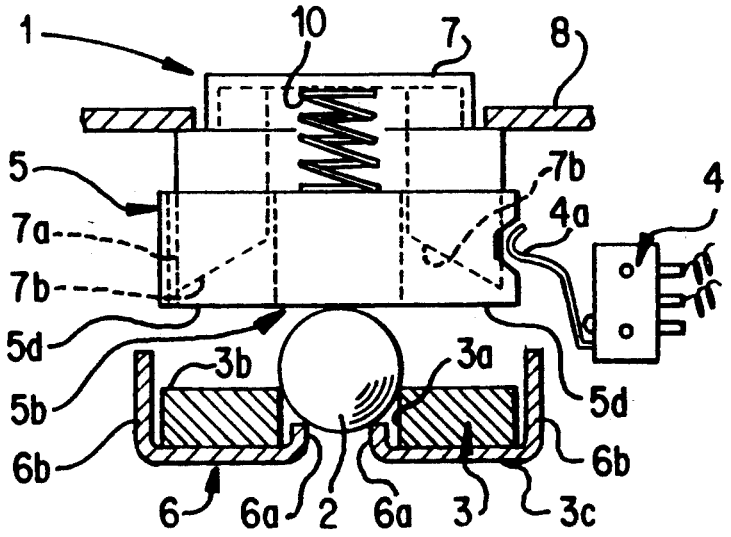
FIG. 10 is a cross-sectional view of essential parts of an acceleration sensor according to a fourth embodiment of the invention.
Figure 11:
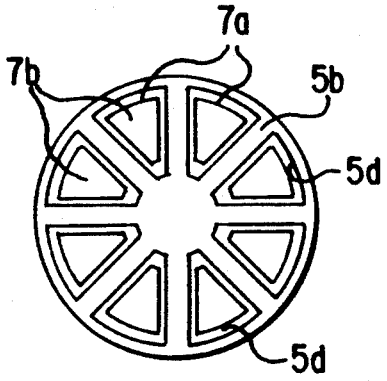
FIG. 11 is a plan view of a switch changeover member appearing in FIG. 10, showing a surface thereof which can be brought into contact with the inertial mass.
Figure 12:
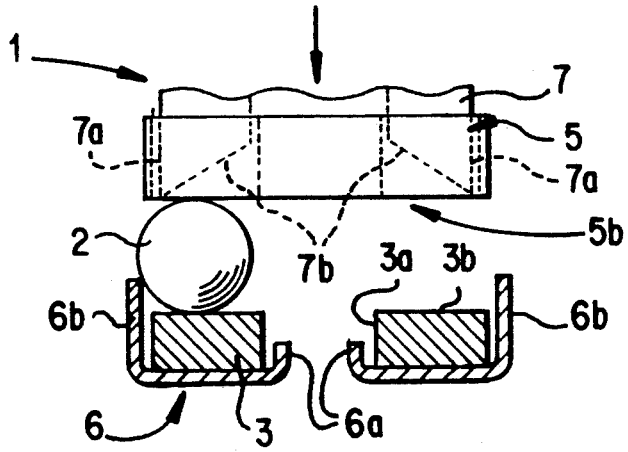
FIG. 12 is a fragmentary cross-sectional view of the acceleration sensor of FIG. 10 in a state in which a resetting member thereof is pressed down.

Next, a fourth embodiment of the invention will be described with reference to FIGS. 10 to 12.

In the acceleration sensor 1 according to the fourth embodiment, a resetting member 7 is vertically slidably fitted in the switch changeover member 5. A spring 10 is arranged between the resetting member 7 and the switch changeover member 5 and urges the switch changeover member 5 in urging contact with the inertial mass 2. The switch changeover member 5 is formed therethrough with a plurality of radially extending openings 5*d* opening in the contact surface 5*b* thereof, while the resetting member 7 has a corresponding number of legs 7*a* slidably fitted through the respective openings 5*b* for projection out of the openings 5*d* to abut on the inertial mass 2 when the resetting member 7 is pressed down. Each leg 7*a* has a contact surface which can be brought into contact with the inertial mass 2. The contact surface comprises a sloping surface 7*b* for causing the interial mass 2 to return to the holding through hole 3*a* when the resetting member 7 is pressed down while the inertial mass 2 is on the surface 3*b* of the magnet 3.

Further, in the fourth embodiment, the peripheral portion 6*b* of the magnetic number 6 is upwardly bent such that its peripheral edge is located at at level higher than that of the peripheral portion 6*b* in the first embodiment, to also play the role of a stopper for the inertial mass 2.

Next, a fifth embodiment of the invention will be described with reference to FIGS. 13 to 15.

In the acceleration sensor 1 according to the fifth embodiment, the inertial mass 2 is connected to a hemispherical fulcrum 50 as the switch changeover member via a rod 51 to form an inertial mass assembly 60 in the form of a pendulum. The casing 8 has an opening 8*a* formed through its bottom wall and having a predetermined diameter relative to the rod 51. Slidably fitted within the casing 8 is a holder 52 having the switch 4 fixedly embedded therein, which is urged downward by a spring 53. Further, the holder 52 has a hemispherical holding surface 52*a* having a central opening at a location corresponding to the opening 8*a*, and an internal space 52*b* accommodating the movable contact 4*a* of the switch 4 and the hemispherical fulcrum 50. On the top of the holder 52, there is formed a handle 70 as the resetting member.

Further, in the fifth embodiment, a columnar projection 6*a'* is formed integrally on a central portion of the magnetic member 6 in a fashion projecting into the holding through hole 3*a* of the magnet 3.

Figure 13:
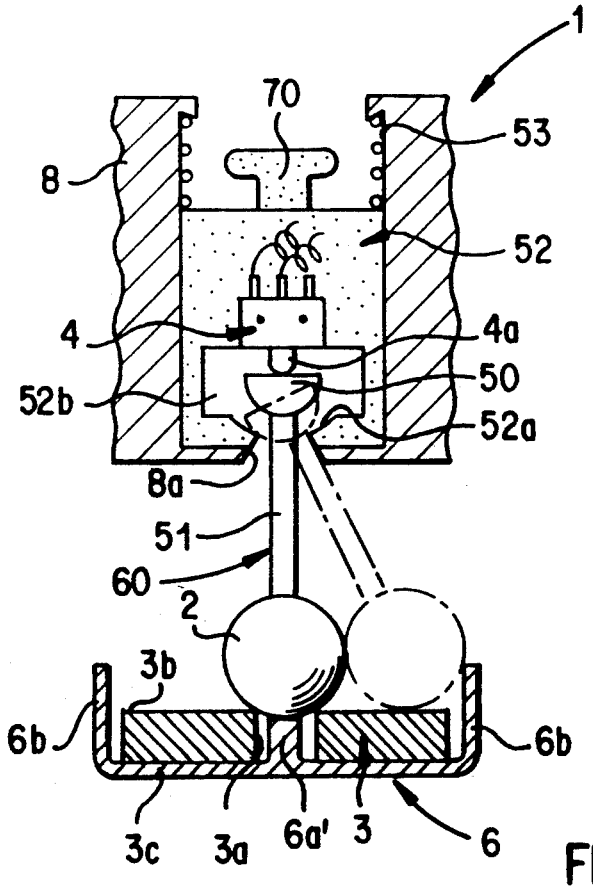
FIG. 13 is a cross-sectional view of essential parts of an acceleration sensor according to a fifth embodiment of the invention.

In the thus constructed acceleration sensor 1 according to the fifth embodiment, normally, the inertial mass 2 of the inertial mass assembly 60 in the form of a pendulum is held in the holding through hole 3*a* in such a manner as indicated by the solid line in FIG. 13, with the inertial mass assembly 60 in an upright position. In this position of the inertial mass assembly 60, the hemispherical fulcrum 50 is upwardly biased away from the hemispherical holding surface 52*a* and in urging contact with the movable contact 4*a* of the switch 4.

When acceleration having a predetermined or larger magnitude acts on the sensor, the inertial mass 2 moves out of the holding through hole 3*a* of the magnet 3 onto the surface 3*b* to move on the surface 3*b* toward the outer periphery of the magnet 3, and then is attracted by a strong magnetic force generated at the outer peripheral portion of the magnet 3, and held at the outer periphery of the magnet 3 (a position shown by the one-dot chain line in FIG. 13). During the movement of the inertial mass 2 on the surface 3*b* of the magnet 3 toward the outer periphery thereof, the inertial mass assembly 60 which was in an upright position becomes inclined as shown by the one-dot chain line in FIG. 13, so that the hemispherical fulcrum 50 moves downward away from the movable contact 4*a* and is brought into contact with the hemispherical holding surface 52*a*, whereby the switch 4 is actuated.

Figure 14:
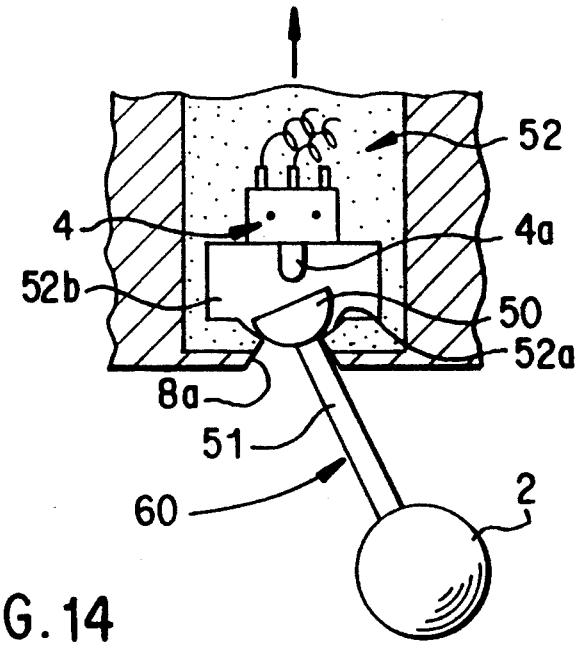
FIG. 14 is a fragmentary cross-sectional view of inertial mass in the form of a pendulum appearing in FIG. 13, which is seen to be in a swung position.
Figure 15:
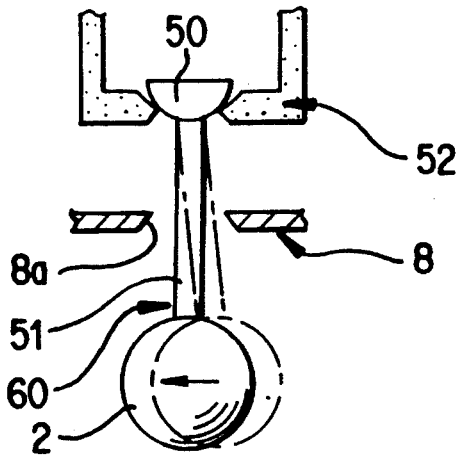
FIG. 15 is a fragmentary cross-sectional view showing the inertial mass in FIG. 13, useful in explaining how the inertial mass is returned to its orginal upright position.

If the handle 70 is pulled upward while the inertial mass assembly 60 is in the position shown by the one-dot chain line in FIG. 13 and the solid line in FIG. 14, the holder 52 moves upward, and the hemispherical fulcrum 50 is also lifted by the hemispherical holding surface 52*a*. During the upward movement of the holder 52, the casing 8 remains stationary so that the hemispherical holding surface 52*a* and the hemispherical fulcrum 50 move upward away from the opening 8*a* of the casing 8. Further, the rod 51 moves upward while being held in contact with the opening 8*a*, so that the inertial mass assembly 60 returns from the inclined position toward the original upright one. When the inertial mass 2 comes near the holding hole 3*a*, it is attracted by a strong magnetic force generated around the holding hole 3*a* and seated into the holding hole 3*a*, which brings the inertial mass assembly 60 back to its upright position. Thus, the resetting of the sensor 1 is completed.

Figure 16:
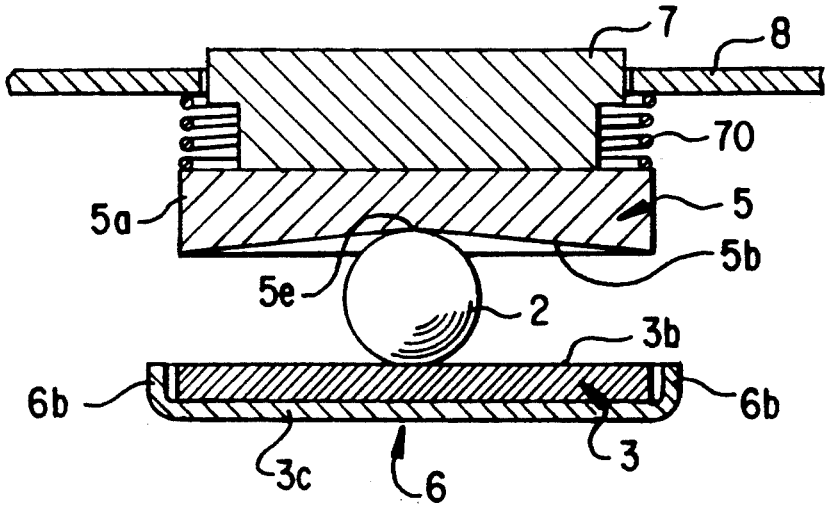
FIG. 16 is a cross-sectional view of essential parts of an acceleration sensor according to a sixth embodiment of the invention.

Next, a sixth embodiment of the invention will be described with reference to FIG. 16.

In the acceleration sensor 1 according to the sixth embodiment, the magnet 3 is in the form of a flat disc, and the magnetic member 6 in the form of a shallow dish is fitted on the magnet 3 in a fashion covering the whole lower side surface 3*c* thereof. The outer peripheral portion 6*b* of the magnetic member 6 is upwardly bent to cover the outer peripheral surface of the magnet 3. In the meanwhile, the lower side surface of the switch changeover member 5 facing the magnet 3 is formed with a sloping surface 5*b'* which downwardly slopes from its central portion 5*e* toward its periphery such that it becomes nearer to the magnet 3. Normally, the top of the inertial mass 2 is always in contact with the central portion 5*e* or its vicinity. Further, a coiled spring 70 urges the inertial mass 2 against the surface of the magnet 3 via the switch changeover member 5, whereby the inertial mass 2 is held in a central reference position.

Figure 17:
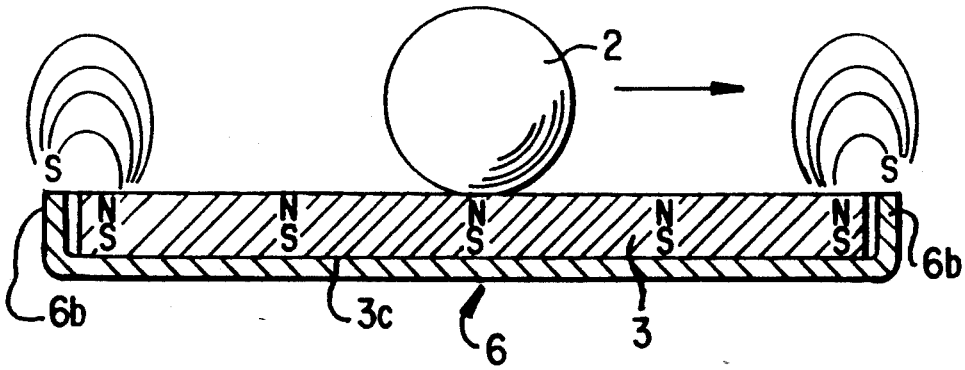
FIG. 17 is a cross-sectional view of a magnet and a magnetic member appearing in FIG. 16, depicting magnetic lines of force generated thereby.

According to the above described construction of the sixth embodiment, unlike the first to fifth embodiments, magnetic lines of force are formed in a manner being concentrated only at the outer periphery of the magnet 3 (as shown in FIG. 17). Therefore, normally, the inertial mass 2 is held in place approximately in the center of the magnet 3 by the force of the spring 70 and the sloping surface 5*b'* of the switch changeover member 5.

This embodiment has the advantage that the predetermined magnitude of acceleration to be detected can be set to a small value.

In the above described embodiments other than the sixth embodiment, if the predetermined magnitude of acceleration to be detected is set to a small value, the inertial mass cannot be properly held at the periphery of the magnet. This is because the inertial mass 2 is held in the reference position due to the magnetic force, the urging force of the spring, not shown, and gravity, whereas it is held at the periphery of the magnet 3 by the magnetic force alone. In order to decrease the predetermined magnitude of acceleration to be detected, it is necessary to decrease the size of the holding hole 3*a* or weaken the magnetic force. Since the size of the holding hole 3*a* has a lower limit beyond which the holding hole 3 cannot be precisely machined, the magnetic force has to be weakened. Accordingly, the magnetic force for holding the inertial mass at the periphery of the magnet is also weakened and hence the magnetic force becomes too weak to hold the inertial mass at the periphery of the magnet. In order to overcome this inconvenience, according to this embodiment, the inertial mass is held in the central reference position by a force independent of the magnetic force. By properly setting the force of the spring 70, the gradient of the sloping surface 5*b*', etc, it is possible to decrease the holding forces acting on the inertial mass 2 to thereby decrease the predetermined magnitude of acceleration that is to be detected. Thus, in this embodiment, the magnetic force of the magnet 3 need not be weakened, and therefore a strong magnetic force can be generated at the outer periphery of the magnet 3. Therefore, when acceleration is exerted on the inertial mass 2 in the direction of the arrow in FIG. 17 to move same on the surface of the magnet 3 toward the outer periphery thereof, the inertial mass 2 is attracted toward the outer periphery by the strong magnetic force concentrated thereon, whereby the inertial mass 2 is positively held thereat.

In addition, the sloping surface 5*b*' can play the same role as that of the sloping surface 5*c* in FIG. 3. Therefore, the resetting of the acceleration sensor 1 can be effected by pressing down the resetting member 7 to cause the inertial mass to move on the surface 3*b* of the magnet 3 back to the central portion 5*e*.

Figure 18:
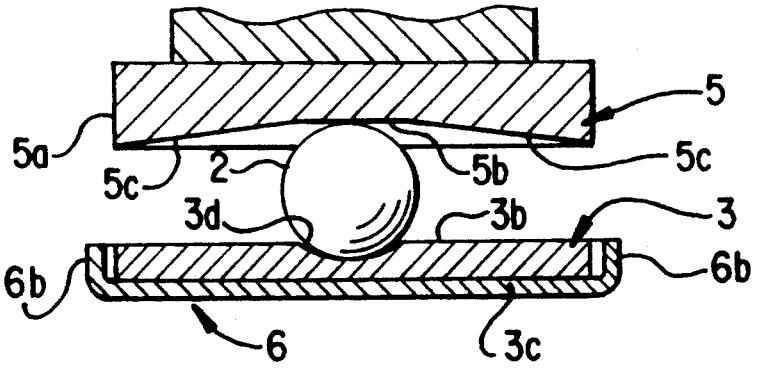
FIG. 18 is a cross-sectional view of essential parts of an acceleration sensor according to a seventh embodiment of the invention.

Next, a seventh embodiment of the invention will be described with reference to FIG. 18.

The acceleration sensor 1 of the seventh embodiment has a basic construction similar to that of the sixth embodiment, except that although the lower end surface of the switch changeover member 5 is shaped similarly to that of the first embodiment (as shown in FIG. 2), a concave recess 3*d* is formed in a central portion of the surface 3*b* of the magnet 3 in the form of a disc, for receiving the inertial mass 2 and holding the same therein. The description of the arrangement and construction of the other elements and parts is omitted since it is substantially identical to that shown in FIG. 16.

According to the seventh embodiment, the inertial mass 2 is held by a weak holding force caused by the concave recess 3*d*. Therefore, similarly to the sixth embodiment, the predetermined magnitude of acceleration that is to be detected can be set to a small value.

Figure 19:
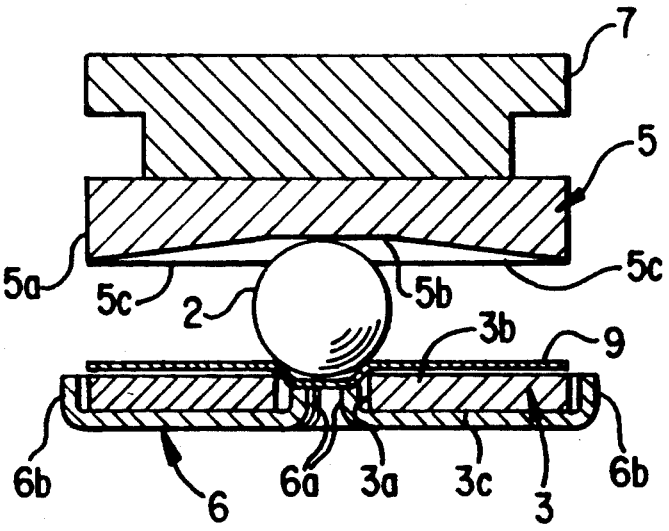
FIG. 19 is a cross-sectional view of essential parts of an acceleration sensor according to an eighth embodiment of the invention.

Next, an eighth embodiment of the invention will be described with reference to FIG. 19.

In the acceleration sensor 1 of the eighth embodiment, a non-magnetic member 9 in the form of a sheet is arranged on the surface 3*b* of the magnet 3. Fig. 19 shows an example of the mon-magnetic sheet member 9 provided in an acceleration sensor having the same construction as the first embodiment shown in FIG. 2. The use of the non-magnetic sheet member 9 is not limited to the first embodiment, but may also be applied to all the acceleration sensors of the second the seventh embodiments.

The provision of the non-magnetic sheet member 9 on the surface 3*b* of the magnet 3 inhibits direct contact between the magnet 3 and the inertial mass 2, to thereby prevent occurrence of frictional resistance therebetween or breakage of the surface 3*b* of the magnet 3.

What is claimed is:

1. An acceleration sensor comprising:

a spherical inertial mass formed of a magnetic material;

a magnet having a holding part for normally holding said inertial mass seated thereat, a first surface with which said inertial mass is brought into contact when said inertial mass moves from said holding part, and a second surface opposite to said first surface;

a switch;

a switch changeover member being actuatable by said inertial mass when said inertial mass moves out of said holding part onto said first surface of said magnet upon exertion of acceleration having a predetermined or larger magnitude on said inertial mass, for changing the position of said switch; and a magnetic member secured to said second surface of said magnet, said magnetic member having one end thereof located in said holding part, and another end thereof shaped to cover an opposed end of said magnet, in a manner such that magnetic lines of force are generated in a manner being concentrated around said holding part of said magnet and on said opposed end of said magnet.

2. An acceleration sensor according to claim 1, wherein said magnet is in the form of an annulus having an inner peripheral surface defining a holding hole as said holding part at a central portion thereof, and an outer peripheral surface, said magnetic member being in the form of an annulus and secured to said second surface of said magnet at a whole area thereof, said magnetic member having an inner peripheral portion bent to cover said inner peripheral surface of said magnet, and an outer peripheral portion bent to cover said outer peripheral surface of said magnet.

3. An acceleration sensor according to claim 2, wherein said switch changeover member is displaceable to thereby change the position of said switch by said inertial mass when said inertial mass moves out of said holding hole onto said first surface of said magnet.

4. An acceleration sensor according to claim 3, wherein said switch changeover member has a contact surface disposed in contact with said inertial mass.

5. An acceleration sensor according to claim 3, including a resetting member provided on said switch changeover member for pressing said switch changeover member against said inertial mass, said contact surface of said switch changeover member having a sloping surface for causing said inertial mass to return to said holding hole when said resetting member is pressed down to press said switch changeover member against said interial mass while said inertial mass is on said first surface of said magnet.

6. An acceleration sensor according to claim 3, including a resetting member arranged at a side of said switch changeover member remote from said inertial mass and being movable relative to said switch changeover member, and a spring interposed between said resetting member and said switch changeover member and urging said switch changeover member in urging contact with said inertial mass, said resetting member having a sloping surface opposed to said inertial mass for causing said inertial mass to return to said holding part when said resetting member is pressed down while said inertial mass is on said first surface of said magnet.

7. An acceleration sensor according to claim 3, including a resetting member slidably fitted in said switch changeover member at a side thereof remote from said inertial mass, and a spring interposed between said resetting member and said switch changeover member and urging said switch changeover member in urging contact with said inertial mass, said switch changeover member having a plurality of radially extending openings formed therethrough, said resetting member having a plurality of legs slidably fitted respectively through said openings for projection out of said openings to abut on said inertial mass when said resetting member is pressed down, each of said legs having a contact surface disposed for contact with said inertial mass, said contact surface of said each leg comprising a sloping surface for causing said inertial mass to return to said holding part when said resetting member is pressed down while said inertial mass is on said first surface of said magnet.

8. An acceleration sensor according to claim 1, wherein said magnet is in the form of an oblong plate, said magnet having one end thereof formed with said holding part, said magnetic member being in the form of an oblong plate and secured to said second surface of said magnet at a whole area thereof, said magnetic member having one end thereof bent to cover said one end of said magnet, and another end thereof bent to cover another end of said magnet.

9. An acceleration sensor according to claim 8, wherein said switch changeover member is disposed for pivotal movement to thereby change the position of said switch by said inertial mass when said inertial mass moves out of said holding part onto said first surface of said magnet.

10. An acceleration sensor according to claim 1, including an inertial mass assembly in the form of a pendulum having a rod, said inertial mass being secured to one end of said rod, and a fulcrum secured to another end of said rod, said fulcrum serving as said switch changeover member, and a holder engaging with said fulcrum for allowing swinging of said inertial mass assembly about said fulcrum, and wherein when said inertial mass moves out of said holding part onto said first surface of said magnet, said inertial mass assembly is swung about said fulcrum, whereby said switch changeover member is displaced to change the position of said switch.

11. An acceleration sensor according to claim 1, including a non-magnetic sheet member arranged on said first surface of said magnet.

12. An acceleration sensor comprising:

a spherical inertial mass formed of a magnetic material;

a holding part for normally holding said inertial mass seated thereat;

holding means for mechanically holding said inertial mass at said holding part;

a magnet forming part of said holding part, said magnet having a first surface with which said inertial mass is brought into contact when said inertial mass moves from said holding part, and a second surface oppsite to said first surface;

a switch;

a switch changeover member being actuatable by said inertial mass when said inertial mass moves away from said holding part along said first surface of said magnet upon exertion of acceleration having a predetermined or larger magnitude on said inertial mass, for changing the position of said switch; and a magnetic member secured to said second surface of said magnet, said magnetic member having one end thereof shaped to cover an opposed end of said magnet, in a manner such that magnetic lines of force are generated in a manner being concentrated solely on said opposed end of said magnet 13. An acceleration sensor according to claim 12, wherein said magnet is in the form of a flat disc, and said magnetic member is in the form of a dish.

14. An acceleration sensor according to claim 12, wherein said holding means comprises urging means urging said inertial mass against said magnet normally at said holding part.

15. An acceleration sensor according to claim 12, wherein said switch changeover member has a surface facing said magnet, said surface having a sloping surface sloping from a central portion thereof to an end thereof such that said surface becomes nearer to said magnet, said surface forming part of said holding part.

16. An acceleration sensor according to claim 12, including a concave recess formed in said first surface of said magnet at a central portion thereof, said concave recess forming part of said holding part.

17. An acceleration sensor according to claim 12, including a non-magnetic sheet member arranged on said first surface of said magnet.

* * * * *